US009840996B2

(12) United States Patent
Beckmann et al.

(10) Patent No.: US 9,840,996 B2
(45) Date of Patent: Dec. 12, 2017

(54) METHOD FOR INSTALLING A SEALING RING

(75) Inventors: Thilo Beckmann, Litzendorf Naisa (DE); Ulrich Fischer, Ditzingen (DE); Johann Bayer, Strullendorf (DE); Guido Pilgram, Gundelsheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 923 days.

(21) Appl. No.: 13/391,234

(22) PCT Filed: Sep. 6, 2010

(86) PCT No.: PCT/EP2010/063008

§ 371 (c)(1),
(2), (4) Date: May 11, 2012

(87) PCT Pub. No.: WO2011/045120

PCT Pub. Date: Apr. 21, 2011

(65) Prior Publication Data

US 2012/0216781 A1 Aug. 30, 2012

(30) Foreign Application Priority Data

Oct. 14, 2009 (DE) ..... 10 2009 045 692

(51) Int. Cl.
*F02M 61/00* (2006.01)
*F02M 61/14* (2006.01)
*F02M 61/16* (2006.01)

(52) U.S. Cl.
CPC ..... *F02M 61/14* (2013.01); *F02M 61/168* (2013.01); *F02M 2200/858* (2013.01); *F02M 2200/95* (2013.01)

(58) Field of Classification Search
CPC ..... F02M 61/14; F02M 61/16; F02M 61/167; F02M 61/168; F02M 2200/858; F02M 2200/95; F02M 2200/16
See application file for complete search history.

(56) References Cited

U.S. PATENT DOCUMENTS 3,319,325 A * 5/1967 Nessamar et al. ..... 29/235
4,647,012 A * 3/1987 Gartner ..... 251/148
(Continued)

FOREIGN PATENT DOCUMENTS

CN 1459002 11/2003
CN 1621680 6/2005
(Continued)

OTHER PUBLICATIONS

International Search Report, PCT International Application No. PCT/EP2010/063008, dated Jan. 11, 2011.

*Primary Examiner* — Hieu T Vo
*Assistant Examiner* — Sherman Manley
(74) *Attorney, Agent, or Firm* — Norton Rose Fulbright US LLP; Gerard Messina

(57) ABSTRACT

A method for installing a sealing ring in a ring groove of an injector, in particular a fuel injector, in which the diameter of the sealing ring is enlarged with the aid of an enlarging tool and is inserted into the ring groove, and the enlarged sealing ring accommodated in the ring groove is reshaped to a predefined sealing dimension with the aid of a calibration tool. For the purpose of shifting a residual ring gap remaining in the ring groove during the reshaping process to the groove flank of the ring groove facing away from the combustion chamber, the reshaping process of the sealing ring is carried out by removing the calibration tool from the fuel injector.

6 Claims, 2 Drawing Sheets

(56) References Cited

U.S. PATENT DOCUMENTS

| | | | | |
|---|---|---|---|---|
| 5,752,487 | A * | 5/1998 | Harrell et al. | 123/470 |
| 6,615,802 | B2 * | 9/2003 | Reiter et al. | 123/470 |
| 6,808,133 | B1 * | 10/2004 | Stier | 239/585.1 |
| 6,921,035 | B2 | 7/2005 | Hohl | |
| 7,523,742 | B2 * | 4/2009 | Tsuchiya et al. | 123/470 |
| 2003/0168534 | A1 * | 9/2003 | Hohl | 239/587.1 |
| 2004/0124276 | A1 | 7/2004 | Berger et al. | |
| 2005/0109325 | A1 * | 5/2005 | Tomita | 123/470 |
| 2008/0257990 | A1 * | 10/2008 | Matteucci et al. | 239/533.9 |
| 2008/0314365 | A1 * | 12/2008 | Daniel et al. | 123/470 |

FOREIGN PATENT DOCUMENTS

| | | |
|---|---|---|
| CN | 1886591 | 12/2006 |
| DE | 19946602 | 4/2001 |
| JP | 2002081548 | 3/2002 |
| JP | 2002-364494 | 12/2002 |
| JP | 2004-506135 | 2/2004 |
| JP | 2004-518873 | 6/2004 |
| JP | 2004-353472 | 12/2004 |
| JP | 2005-155419 | 6/2005 |
| JP | 2005-163561 | 6/2005 |
| WO | WO 02073026 | 9/2002 |
| WO | WO 03060316 | 7/2003 |

* cited by examiner

METHOD FOR INSTALLING A SEALING RING

FIELD OF THE INVENTION

The present invention relates to a method for installing a sealing ring on an injector, in particular a fuel injector for an internal combustion engine.

BACKGROUND INFORMATION

Fuel injectors which meter fuel under high pressure depending on the driving condition of the vehicle and inject the fuel in a fine spray directly into the combustion chamber of the internal combustion engine are used for direct injection in internal combustion engines designed as gasoline engines. Such a fuel injector is described in German Patent No. DE 199 46 602 A1, for example. Such a fuel injector is inserted into a bore of a cylinder head of the internal combustion engine that seals a combustion chamber in such a way that the injector tip provided with injection openings protrudes into the combustion chamber and the sealing ring situated on the fuel injector creates a combustion chamber seal between the fuel injector and the bore wall of the cylinder head bore. The sealing ring typically having a rectangular cross section is made of a less elastic plastic, e.g., polytetrafluoroethylene (PTFE). The sealing ring is inserted into a ring groove present in the fuel injector prior to installation of the fuel injector in the cylinder head. Since the inner diameter of the seal adapted to the diameter of the groove base of the ring groove is smaller than the diameter of the ring groove on the groove edge, an enlarging tool 11—as schematically shown in FIG. 1—is placed on the tip of the fuel injector (FIG. 1*a*) and sealing ring 12 is pushed via enlarging tool 11 onto the fuel injector, whereby sealing ring 12 is enlarged and may thus be displaced on fuel injector 10 into ring groove 13 (FIG. 1*b*). Enlarging tool 11 is then removed from fuel injector 10 (FIG. 1*c*). Due to the low elasticity of the material of sealing ring 12, sealing ring 12 initially remains enlarged and is not fully pressed into ring groove 13 (FIG. 1*c*). Therefore, sealing ring 12 is reshaped with the aid of a so-called calibration tool 14 to its final outer diameter, its predefined sealing dimension. Calibration tool 14 is placed on the tip of fuel injector 10 and is pushed over sealing ring 12 for this purpose (FIG. 1*d*). To reshape sealing ring 12, calibration tool 14 has a hollow cone 15 which tapers against the slide-on direction with respect to the inner diameter, the smallest inner diameter on the side of hollow cone 15 facing away from fuel injector 10 being adapted to the desired sealing dimension of sealing ring 12. During slide-on of calibration tool 14, hollow cone 15 increasingly deforms sealing ring 12 until the desired outer diameter, the so-called sealing dimension, is achieved and simultaneously presses sealing ring 12 into ring groove 13. During this calibration of sealing ring 12, it is naturally pressed against the flank of ring groove 13 facing away from the combustion chamber. To prevent very high press-in forces and shearing off of sealing ring 12 during the installation of fuel injector 10 in the cylinder head, ring groove 13 filled by sealing ring 12 must not be overfilled by sealing ring 12. Sealing ring 12 is therefore dimensioned in such a way that a residual ring gap 16 remains in ring groove 12 after reshaping. Since, as already mentioned, sealing ring 12 is pressed during the calibration process onto the flank of ring groove 13 facing away from the combustion chamber, this residual ring gap 16 is formed at the groove flank facing the combustion chamber. This residual ring gap 16 is filled by combustion residues during operation of the internal combustion engine, thus additionally protecting sealing ring 12 from the high thermal load of the exhaust gases in the combustion chamber.

When using fuels containing ethanol and preferably in the case of central installation of the fuel injector in the cylinder head, these combustion residues are lacking and hot particles become caught in the residual air gap. The hot particles may burn through the sealing ring, resulting in a leaky combustion chamber seal and consequent failure of the fuel injector.

SUMMARY

An example method of the present invention for installing the sealing ring may have the advantage that the reshaping process of the sealing ring caused by removal, not application, of the calibration tool results in shifting of the residual ring gap remaining in the ring groove toward the groove flank facing away from the combustion chamber. The sealing ring is supported by the groove flank of the ring groove facing the combustion chamber and retains this position even during installation in the cylinder head. As a result, hot particles are not able to become caught in front of the sealing ring and do not cause thermal damage to the sealing ring.

According to an advantageous specific embodiment of the present invention, the sealing ring is reshaped by a hollow cone which is formed in the calibration tool and tapers against the removal direction of the calibration tool from the fuel injector with respect to the inner cone diameter and whose smallest inner diameter is adapted to the predefined sealing dimension of the sealing ring. The calibration tool is placed on the fuel injector behind the sealing ring situated in the ring groove, is closed, and removed over the sealing ring from the fuel injector, thus pressing the sealing ring into the ring groove and reshaping it to its sealing dimension.

BRIEF DESCRIPTION OF THE DRAWINGS

The present invention is explained in greater detail on the basis of an exemplary embodiment in the following description illustrated in FIG. 2.

DETAILED DESCRIPTION OF EXAMPLE EMBODIMENTS

Figure 1:
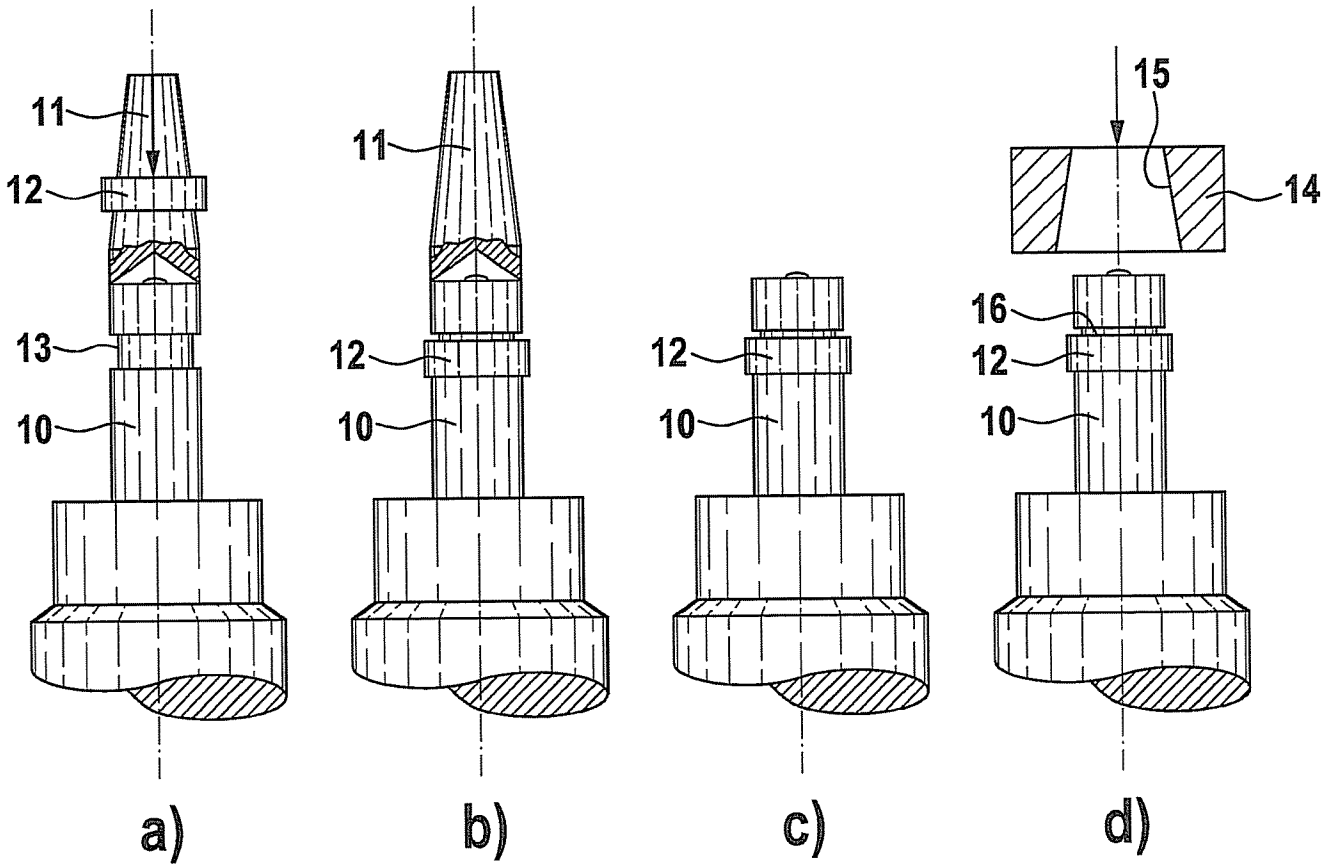
Fig. 1 Related Art
FIG. 1 shows an illustration of the conventional installation method for a sealing ring to be installed on a fuel injector in four individual method steps a through d.
Figure 2:
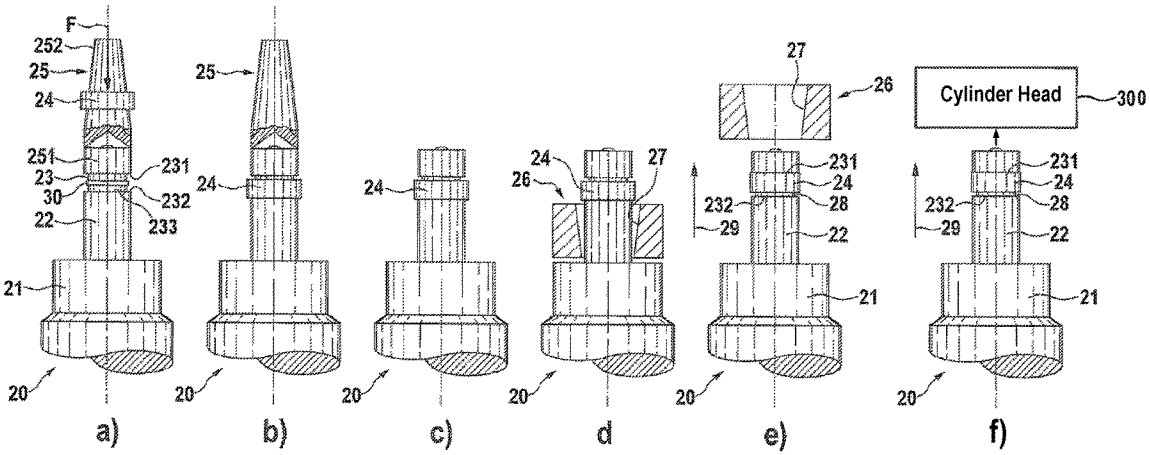
FIG. 2 shows an illustration of an example of the installation method of the present invention for installing the sealing ring on a fuel injector in five individual method steps a through e, followed by installation of the injector in a cylinder head in a step f.

Fuel injector 20 for an internal combustion engine of a motor vehicle shown in a sectional side view in FIG. 2 as an example of an injector is used for example for metered injection of finely sprayed fuel into the combustion chamber of an internal combustion engine and is inserted for this purpose into a cylinder head 300 sealing the combustion chamber of an internal combustion engine, the tip of fuel injector 20 protruding into the cylinder head 300 of the combustion chamber. Fuel injector 20 has a valve housing 21 and a valve seat support 22 protruding axially therefrom and having a smaller outer diameter than valve housing 21. Valve seat support 22 is sealed in a conventional manner at an end facing away from valve housing 21 by a valve seat body not shown here on which a valve seat surrounding a valve opening is formed and to which a spray hole disk is attached downstream from the valve opening. A ring groove 23 is inserted from the outside into valve seat support 22 at an axial distance from the free end of valve seat support 22. Ring groove 23 has two groove flanks 231 and 232 and a groove base 233 and a groove edge whose diameter is greater than the groove base diameter. A raised, circumferential bead 30 is molded as one piece, preferably in the center of groove base 233, the outer diameter of the bead being slightly greater than the groove base diameter and its axial width being significantly smaller than the groove width. A sealing ring 24, which seals fuel injector 20 with respect to a bore wall of a cylinder bore accommodating fuel injector 20 after installation of fuel injector 20 in the cylinder head of the internal combustion chamber, is inserted into ring groove 23. Sealing ring 24 is made of a plastic, e.g., polytetrafluoroethylene (PTFE), which is not sufficiently elastic to be able to simply slide sealing ring 24 onto valve seat support 22 and then snap it into ring groove 23. To allow for this, sealing ring 24 is enlarged via an enlarging tool 25 (FIG. 2*a*) and is inserted into ring groove 23, and enlarged sealing ring 24 accommodated in ring groove 23 is reshaped with the aid of a calibration tool 26 (FIG. 2*d*) to a predefined sealing dimension that is smaller than the outer dimension of enlarged sealing ring 24. Calibration tool 26 is placed for this purpose on fuel injector 20 and the reshaping process of sealing ring 24 is carried out during removal of calibration tool 26 from fuel injector 20. This installation method is illustrated in five method steps in FIG. 2:

Enlarging tool 25 is initially placed on the tip of fuel injector 20, more precisely on the front side of valve seat support 22. Enlarging tool 25 has a cylinder section 251 having an outer diameter that is slightly greater than the outer diameter of valve seat support 22 and having a cone section 252 that is adjacent thereto and has an outer diameter that decreases toward the free end. As shown in FIG. 2*a*, enlarging tool 25 is put on the free end of valve seat support 22 in such a way that cylinder section 251 of enlarging tool 25 is put on valve seat support 22 almost up to groove flank 231. Sealing ring 24 is then pushed onto cone section 252 of enlarging tool 25 and is then pushed with a force F over cylinder section 251 of enlarging tool 25 into ring groove 23. When being pushed over cone section 252, sealing ring 24 is enlarged to the outer diameter of cylinder section 251 and generally retains this enlargement after being placed in ring groove 23 (FIG. 1*b*). After removal of enlarging tool 25 (FIG. 1*c*), calibration tool 26 is put on valve seat support 22 in the region between valve housing 21 and enlarged sealing ring 24 sitting in ring groove 23. Calibration tool 26 is designed in two pieces for this purpose. For example, FIG. 2*d* and FIG. 2*e* show one of the parts of calibration tool 26 that can be put onto valve seat support 22 with another such part. Alternatively, calibration tool 26 may be in one piece and is then put on valve seat support 22 prior to the application of enlarging tool 25. For reshaping sealing ring 24, calibration tool 26 has a hollow cone 27, which tapers against the removal direction of calibration tool 26 indicated in FIG. 2*d* by arrow 29 from fuel injector 20, i.e., its inner cone diameter decreases. If closed calibration tool 26 is removed from fuel injector 20, hollow cone 27 shapes sealing ring 24 to the desired sealing dimension, which is determined by the smallest inner diameter of hollow cone 27, and simultaneously presses sealing ring 24 into ring groove 23 (FIG. 2*e*), bead 30 being pressed at groove base 233 into sealing ring 24. To prevent a ring groove 23 from being overfilled by sealing ring 24 during the reshaping process, sealing ring 24 is dimensioned in such a way that a residual ring gap 28 remains in ring groove 23 under all conditions of the reshaping process. Since sealing ring 24 is pressed against groove flank 231 of ring groove 23 facing away from housing 21 during the reshaping process which takes place during the removal of calibration tool 26, this residual ring gap 28 is formed on groove flank 232 facing housing 21. When installing fuel injector 20 in the cylinder head of the internal combustion engine, sealing ring 24 remains in this position since bead 30 reliably prevents possible pushing back of sealing ring 24 by frictional forces acting on the sealing ring. As a result, there is no ring gap between sealing ring 24 and the combustion chamber, so that hot particles do not become caught in front of sealing ring 24 and are not able to thermally damage sealing ring 24.

What is claimed is:

1. A method for installing a sealing ring on a fuel injector for an internal combustion engine in a ring groove formed at the injector, the ring groove having groove edges with a groove edge diameter that is greater than the groove base diameter, the method comprising:

enlarging a diameter of the sealing ring with the aid of an enlarging tool;

inserting the sealing ring into the ring groove in an insertion direction that is from a first end of the injector towards a second end of the injector;

subsequent to the insertion of the sealing ring into the ring groove, positioning a calibration tool on the injector at a position between the sealing ring and the second end of the injector; and subsequent to the positioning, shifting the calibration tool towards the first end of, and removing the calibration tool from, the injector, thereby reshaping the enlarged sealing ring in the ring groove, the reshaping of the sealing ring lessening an outer dimension of the sealing ring to a predefined sealing dimension;

wherein a residual gap is present between the sealing ring and one of the groove edges, and a raised, circumferential, narrow bead, which is pressed into the inner ring surface of the sealing ring, is formed at the groove base.

2. The method as recited in claim 1, wherein the reshaping is carried out by a hollow cone that is formed in the calibration tool and tapers against a removal direction of the calibration tool, a smallest inner cone diameter of the hollow cone being adapted to a predefined sealing dimension of the sealing ring.

3. The method as recited in claim 1, wherein the enlarging tool has a cylinder section and a cone section connected thereto and tapers toward a free end, the enlarging tool being placed with the cylinder section on a front side on the fuel injector, the sealing ring being pushed over the cone section and the cylinder section onto the fuel injector and inserted into the ring groove, and then the enlarging tool being removed from the fuel injector.

4. The method as recited in claim 1, wherein the fuel injector has a valve housing and a valve seat support protruding axially from the valve housing, and the ring groove is inserted from an outside into the valve seat support.

5. The method as recited in claim 1, further comprising installing the fuel injector in a cylinder head of the internal combustion engine, wherein:

the groove edges include a first edge and a second edge, the second edge being further from the internal combustion engine than the first edge the reshaping carried out by the removal of the calibration tool shifts the residual gap away from the first edge towards the second edge, with the sealing ring being braced against the first edge the bead retains the bracing of the sealing ring against the first edge throughout the installation of the fuel injector in the cylinder head.

6. The method as recited in claim 1, wherein the positioning of the calibration tool on the injector includes applying multiple parts of which the calibration tool is formed to the injector and then closing the calibration tool with an inner conical surface of the calibration tool enclosing the injector at the position that is between the sealing ring and the second end of the injector.

* * * * *